US007434344B2

(12) United States Patent
Golan

(10) Patent No.: US 7,434,344 B2
(45) Date of Patent: Oct. 14, 2008

(54) HANDLE FOR FIREARM

(75) Inventor: Amos Golan, Kfar Azar (IL)

(73) Assignee: Corner Shot Holdings, L.L.C., Coral Gables, FL (US)

( * ) Notice: Subject to any disclaimer, the term of this patent is extended or adjusted under 35 U.S.C. 154(b) by 0 days.

(21) Appl. No.: 10/352,146

(22) Filed: Jan. 28, 2003

(65) Prior Publication Data

US 2004/0144010 A1 Jul. 29, 2004

(51) Int. Cl.
*F41C 23/00* (2006.01)

(52) U.S. Cl. ..... 42/72; 89/1.42

(58) Field of Classification Search ..... 89/1.42, 89/1.1; 42/71.01–73, 118
See application file for complete search history.

(56) References Cited

U.S. PATENT DOCUMENTS 146,651 A * 1/1874 Byrkit ..... 42/73
669,871 A * 3/1901 Zoeller ..... 42/73
914,675 A * 3/1909 Renfors ..... 42/72
1,111,905 A * 9/1914 Keeran ..... 42/72
1,184,078 A * 5/1916 Cooke ..... 42/118
1,222,778 A * 4/1917 McCleary ..... 42/73
1,260,285 A * 3/1918 Cordell ..... 42/118
1,307,594 A * 6/1919 Rasmussen ..... 89/1.1
1,386,247 A * 8/1921 Fordyce ..... 89/136
1,554,556 A * 9/1925 Camus ..... 42/72
1,869,086 A * 7/1932 Ash ..... 42/73
1,934,732 A * 11/1933 Nahm et al. ..... 109/38
D136,041 S * 7/1943 Reising ..... D22/103
2,435,217 A * 2/1948 Howell ..... 42/72
2,441,487 A * 5/1948 Howard ..... 42/72
2,471,276 A * 5/1949 Manville ..... 42/18
2,547,180 A * 4/1951 Taylor ..... 42/16
3,369,316 A * 2/1968 Miller ..... 42/72
4,321,765 A * 3/1982 Gillum ..... 42/72
4,660,311 A * 4/1987 Breitfeld et al. ..... 42/72
4,677,781 A * 7/1987 Lee ..... 42/70.01
4,735,008 A * 4/1988 Williams ..... 42/71.02
4,869,008 A * 9/1989 Rasmussen ..... 42/71.01
4,878,305 A * 11/1989 Gabrielidis ..... 42/72
5,027,542 A * 7/1991 Simonetti ..... 42/72
5,048,215 A * 9/1991 Davis ..... 42/72
5,068,992 A * 12/1991 Velezis et al. ..... 42/72
5,417,002 A * 5/1995 Guerra ..... 42/72
5,599,187 A * 2/1997 Mesiano ..... 434/19
6,276,085 B1 * 8/2001 Wooten et al. ..... 42/1.08
6,397,507 B1 * 6/2002 Marshall et al. ..... 42/72
6,487,807 B1 * 12/2002 Kopman et al. ..... 42/94
6,526,683 B1 * 3/2003 Crandall ..... 42/40
6,543,173 B1 * 4/2003 Golan ..... 42/75.04
6,598,329 B1 * 7/2003 Alexander ..... 42/71.01

* cited by examiner

*Primary Examiner*—Michelle Clement
(74) *Attorney, Agent, or Firm*—Dekel Patent Ltd.; David Klein

(57) ABSTRACT

A firearm accessory comprising at least one handle that may be attached to a firearm, the firearm comprising a butt and a barrel which define a plane, wherein a longitudinal axis of the firearm lies in the plane, wherein in a gripping position of the at least one handle, the at least one handle angularly extends away from the plane.

7 Claims, 1 Drawing Sheet

HANDLE FOR FIREARM

FIELD OF THE INVENTION

The present invention relates generally to firearms accessories, and particularly to handles that may be fitted on a firearm, which among other things, may permit firing the firearm when held at a distance (e.g., arms length) or at any angle from the shooter's body.

BACKGROUND OF THE INVENTION

In order to fire a firearm and hit a target, it is necessary to aim towards the target and fire a bullet projectile with sufficient force to reach and damage the target. With conventional firearms, such as pistols, revolvers and other handguns, rifles, submachine guns and the like, an elongate barrel is provided to direct the bullet in the direction in which the firearm is aimed, and to provide a path along which the bullet is accelerated.

In many cases, it would be desirable to hit a target lying at an angle to, or around a corner shelter or cover from, the person firing the gun. With conventional firearms, this is impossible, since the barrel is straight and can only be fired forwards or backwards. Holding the firearm extended from the body is not practical, since the user must still press the trigger, thereby exposing the hand or finger to enemy fire, and the target is not readily visible for aiming thereat.

SUMMARY OF THE INVENTION

The present invention seeks to provide a novel accessory for a firearm comprising side extending handles, as is described more in detail hereinbelow. The firearm accessory of the invention, among other things, may permit firing the firearm when held at a distance (e.g., arms length) or at any angle from the shooter's body. The handles may be particularly useful for shooting the firearm around corners. The handles may also be used as carrying handles or other useful features, such as but not limited to, steadying the firearm against a surface when firing.

The handles of the invention may be supplied as a separate kit for attachment to an existing firearm. Alternatively, a firearm manufacturer or dealer may be supply the firearm already equipped with the handles.

There is thus provided in accordance with an embodiment of the present invention apparatus comprising at least one handle attached to a firearm, the firearm comprising a butt and a barrel which define a plane, wherein a longitudinal axis of the firearm lies in the plane, wherein in a gripping position of the at least one handle, the at least one handle angularly extends away from the plane.

In accordance with an embodiment of the present invention the at least one handle extends from the firearm rearward or forward of the ammunition firing portion.

Further in accordance with an embodiment of the present invention two such handles are provided, wherein one of the handles extends from the firearm forward of the ammunition firing portion and the other handle extends from the firearm rearward of the ammunition firing portion. For example, one of the handles may extend from the butt and the other handle may extend from a handguard of the firearm.

Still further in accordance with an embodiment of the present invention the at least one handle comprises a trigger coupled to the trigger of the firearm.

In accordance with an embodiment of the present invention the at least one handle is telescopic.

Further in accordance with an embodiment of the present invention the at least one handle in a stored position is generally parallel to the plane.

In accordance with an embodiment of the present invention the at least one handle is pivotally attached to the firearm.

Further in accordance with an embodiment of the present invention the at least one handle is pivotally attached to the firearm with a pivoting connector adapted to be fixed at a plurality of angles. The at least one handle may be pivotable about an axis that lies or does not lie in the plane.

Still further in accordance with an embodiment of the present invention a first sight is provided through which a target is viewable in the plane and a second sight is provided through which the target is viewable at an angle to (e.g., generally perpendicular to) the plane.

BRIEF DESCRIPTION OF THE DRAWINGS

The present invention will be understood and appreciated more fully from the following detailed description, taken in conjunction with the drawings in which.

DETAILED DESCRIPTION OF A PREFERRED EMBODIMENT

Figure 1:
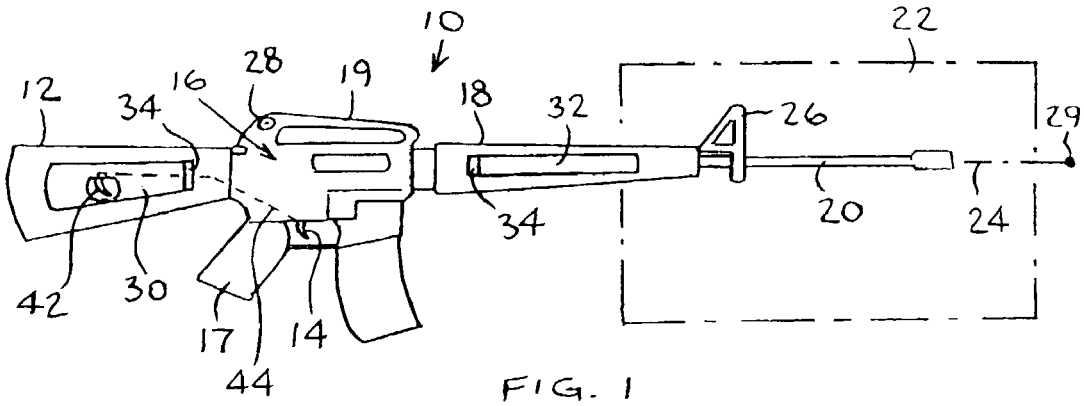
FIG. 1 is a simplified pictorial illustration of a firearm with side handles, constructed and operative in accordance with an embodiment of the present invention, with the handles in a stored position.
Figure 2:
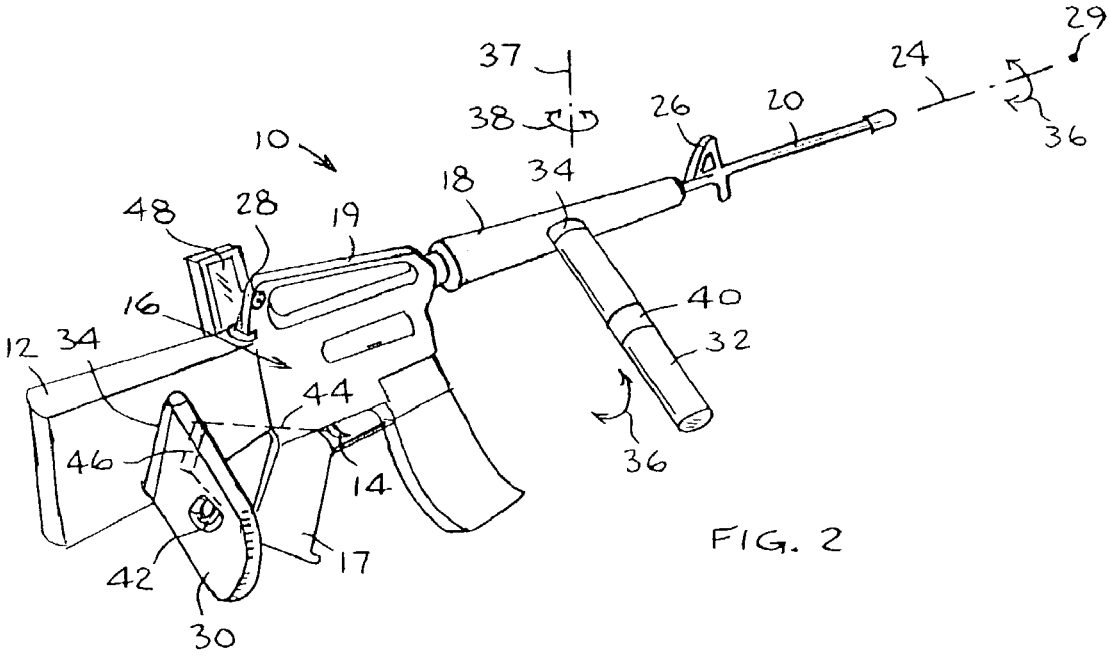
FIG. 2 is a simplified illustration of the firearm of FIG. 1, with the side handles in a deployed position.

Reference is now made to FIGS. 1 and 2, which illustrate a firearm 10, constructed and operative in accordance with an embodiment of the present invention.

Firearm 10 may comprise a butt 12, a trigger 14, an ammunition firing portion 16 (which may include, but is not limited to, a chamber, a bolt carrier, a magazine and the like), a pistol grip 17, a handguard 18, a carrying handle 19 and a barrel 20. Firearm 10 is illustrated for exemplary purposes only as a Colt M-16 automatic rifle, but the invention is not limited to this firearm and may be carried out with other firearms, such as but not limited to, assault rifles, sniper rifles, handguns, pistols, revolvers, etc. The butt 12 and barrel 20 define a plane 22 and a longitudinal axis 24 of firearm 10 lies in plane 22. Firearm 10 may comprise front and rear sights 26 and 28, respectively, which individually or in combination allow viewing a target 29 along longitudinal axis 24 in plane 22.

In accordance with an embodiment of the present invention, one or more additional handles are attached in any manner (fixed or pivoted) to firearm 10. In the illustrated embodiment, one handle 30 is pivotally attached to butt 12, rearward of ammunition firing portion 16, and another handle 32 is pivotally attached to handguard 18, forward of said ammunition firing portion 16. However, the invention is not limited to this arrangement, and the handles may be attached at other positions on firearm 10 (e.g., on a top portion thereof and arranged to swing outwards, or on pistol grip 17 and/or the magazine holder). As another alternative, the pistol grip 17 may itself serve as one of the handles 30 or 32, wherein pistol grip 17 is pivotable with respect to firearm 10 about axis 24. In such an embodiment, pistol grip 17 is pivotable from a position parallel with plane 22 to a gripping position angularly extending away from plane 22.

FIG. 1 illustrates handles 30 and 32 in a stored position, wherein they are generally parallel to plane 22. FIG. 2 illustrates handles 30 and 32 in a deployed position (i.e., gripping position, wherein the handles may be gripped to fire firearm 10). In the gripping position, the handles 30 and 32 angularly extend away from plane 22. In the illustrated embodiment, handles 30 and 32 are generally perpendicular to plane 22 in the gripping position, but the invention is not limited to this angle.

The handles 30 and 32 may be pivotally attached to firearm 10 with a pivoting connector 34. Pivoting connector 34 may be fixed at a plurality of angles, such as by means of a ratchet mechanism, locking mechanism, pawl and detents and the like (not shown). Pivoting connector 34 may permit pivoting the handles 30 and 32 in a plurality of directions, such as about axis 24 (which lies in plane 22), as indicated by an arrow 36 (elevational rotation), or about an axis that does not lie in plane 22, such as a vertical axis 37, as indicated by an arrow 38 (azimuthal rotation).

Handle 30 and/or 32 may be telescopic, wherein it comprises one or more telescopic sections 40. The handles 30 and 32 may be of any shape or size, and may be constructed of any suitable material. The handles 30 and 32 may be of identical or different shapes or sizes. The handles 30 and 32 may be arranged to swing outwards towards either end of firearm 10.

Either one of the handles, such as handle 30, may comprise a trigger 42 coupled to trigger 14 of firearm 10. For example, a wire 44 may connect trigger 14 of firearm 10 to a linkage assembly 46, which is connected to trigger 42 of handle 30. Pulling trigger 42 in a direction perpendicular to axis 24 pulls trigger 14 to fire firearm 10. It is appreciated that the invention is not limited to this arrangement and other coupling arrangements may be used instead. Alternatively, in the embodiment wherein pistol grip 17 may serves as one of the handles, the trigger 14 may be adapted to pivot together with the pistol grip 17 to the gripping position angularly extending away from plane 22 and serve as the trigger 42.

In accordance with an embodiment of the present invention, an auxiliary sight 48 may be provided attached to firearm 10, for viewing target 29 at an angle to plane 22, such as but not limited to, generally perpendicular to plane 22. Auxiliary sight 48 may be foldable with respect to firearm 10, and may comprise, without limitation, a mirror or camera device or combination thereof.

In use, handles 30 and 32 may be folded out form the stored position shown in FIG. 1 to the deployed position shown in FIG. 2. Firearm 10 may then be held by handles 30 and 32 and fired when held at arms length from the shooter's body, with the target 29 sighted by auxiliary sight 48. This may be particularly useful for shooting around corners and the like.

It will be appreciated by persons skilled in the art that the present invention is not limited by what has been particularly shown and described hereinabove. Rather the scope of the present invention includes both combinations and subcombinations of the features described hereinabove as well as modifications and variations thereof which would occur to a person of skill in the art upon reading the foregoing description and which are not in the prior art.

What is claimed is:

1. Apparatus comprising:

a firearm comprising a shoulder stock and a barrel; and at least one handle having one end pivotally attached to said shoulder stock of said firearm with a pivoting connector directly attached to said shoulder stock that permits pivoting said at least one handle with respect to said shoulder stock, such that said at least handle pivots out towards a left side or a right side of said shoulder stock, wherein said at least one handle comprises a trigger and said firearm comprises a trigger, and the two triggers are coupled to each other, wherein pulling the trigger of said at least one handle pulls the trigger of said firearm.

2. The apparatus according to claim 1, wherein said pivoting connector is adapted to be fixed at a plurality of angles.

3. The apparatus according to claim 1, further comprising a first sight through which a target is viewable in a center plane and a second sight through which the target is viewable at an angle to said center plane.

4. The apparatus according to claim 3, wherein said second sight is arranged with respect to said first sight such that the target is viewable generally perpendicular to said center plane.

5. The apparatus according to claim 1, wherein said at least one handle in a stored position is in a stored plane generally parallel to said shoulder stock.

6. The apparatus according to claim 1, wherein said shoulder stock and said barrel define a plane, and a longitudinal axis of said firearm lies in said plane, and said firearm comprises front and rear sights for viewing a target along said longitudinal axis in said plane, and wherein the left and right sides of said shoulder stock are defined with said front and rear sights positioned vertically above said trigger of said firearm.

7. The apparatus according to claim 1, wherein said firearm comprises a handguard and another handle is pivotally attached to said handguard.

* * * * *